US011835917B2

(12) United States Patent
Wang et al.

(10) Patent No.: US 11,835,917 B2
(45) Date of Patent: Dec. 5, 2023

(54) FIXING DEVICE AND IMAGE FORMING APPARATUS WITH IMPROVED STABILITY FOR CHIP

(71) Applicant: Zhuhai Pantum Electronics Co., Ltd., Zhuhai (CN)

(72) Inventors: Datong Wang, Zhuhai (CN); Xining Ding, Zhuhai (CN); Xinchao He, Zhuhai (CN); Wenqian Rong, Zhuhai (CN)

(73) Assignee: ZHUHAI PANTUM ELECTRONICS CO., LTD., Zhuhai (CN)

( * ) Notice: Subject to any disclaimer, the term of this patent is extended or adjusted under 35 U.S.C. 154(b) by 0 days.

(21) Appl. No.: 17/837,018

(22) Filed: Jun. 9, 2022

(65) Prior Publication Data

US 2022/0299933 A1 Sep. 22, 2022

Related U.S. Application Data

(63) Continuation of application No. PCT/CN2020/128746, filed on Nov. 13, 2020.

(30) Foreign Application Priority Data

Dec. 11, 2019 (CN) ..... 201922211858.3

(51) Int. Cl.
*G03G 21/16* (2006.01)
*G03G 15/20* (2006.01)

(52) U.S. Cl.
CPC ..... *G03G 21/1685* (2013.01); *G03G 15/2064* (2013.01)

(58) Field of Classification Search
CPC ..... G03G 21/1685; G03G 15/2064
(Continued)

(56) References Cited

U.S. PATENT DOCUMENTS

2011/0236037 A1 9/2011 Ogawahara
2016/0161912 A1* 6/2016 Uto ..... G03G 21/1867 439/620.22

(Continued)

FOREIGN PATENT DOCUMENTS

CN 106207644 A 12/2016
CN 106483807 A 3/2017

(Continued)

OTHER PUBLICATIONS

The World Intellectual Property Organization (WIPO) International Search Report for PCT/CN2020/128746 datedd Feb. 18, 2021 4 Pages (including translation).

*Primary Examiner* — Quana Grainger
(74) *Attorney, Agent, or Firm* — ANOVA LAW GROUP, PLLC

(57) ABSTRACT

The present disclosure provides a fixing device and an image forming apparatus. Fixing device includes a device main body, including a heater, where the device main body includes a driving end connected to a power outputting part of the image forming apparatus and a non-driving end opposite to the driving end; a locking element, disposed on the non-driving end of the device main body; and a chip, including a contact part. When the device main body is installed on the image forming apparatus, the locking element is connected to the image forming apparatus, and the contact part of the chip is electrically connected to the image forming apparatus; and a projection of the contact part of the chip in an axial direction of the heater intersects a projection of the locking element in the axial direction of the heater.

17 Claims, 4 Drawing Sheets

(58) Field of Classification Search
USPC ..... 399/385
See application file for complete search history.

(56) References Cited

U.S. PATENT DOCUMENTS

| | | | | |
|---|---|---|---|---|
| 2017/0060069 | A1* | 3/2017 | Endo | G03G 15/80 |
| 2019/0041782 | A1 | 2/2019 | Nishikawa et al. | |

FOREIGN PATENT DOCUMENTS

| | | | |
|---|---|---|---|
| CN | 211086925 | U | 7/2020 |
| JP | H11202722 | A | 7/1999 |
| JP | 2011197372 | A | 10/2011 |
| JP | 2017049356 | A | 3/2017 |
| KR | 20170062648 | A | 6/2017 |
| WO | 2019013445 | A1 | 1/2019 |

* cited by examiner

FIXING DEVICE AND IMAGE FORMING APPARATUS WITH IMPROVED STABILITY FOR CHIP

CROSS-REFERENCE TO RELATED APPLICATION

This application is a continuation of International Application No. PCT/CN2020/128746, filed on Nov. 13, 2020, which claims the priority to Chinese patent application No. 201922211858.3, entitled "Fixing Device and Image Forming Apparatus", filed on Dec. 11, 2019, in the China National Intellectual Property Administration, the entirety of which is incorporated herein by its reference.

TECHNICAL FIELD

The present disclosure generally relates to the field of image forming apparatus technology and, more particularly, relates to a fixing device and an image forming apparatus including the fixing device.

BACKGROUND

Image forming apparatuses, such as copiers, printers, fax machines, multi-function machines and the like, normally include paper feeding rollers, conveying rollers, paper discharging rollers, photosensitive drums, transferring rollers and the like. The photosensitive drum and the transferring roller may form a clamping position. When the paper is conveyed to the clamping position between the photosensitive drum and the transferring roller under the action of the feeding roller and the conveying roller, a visible toner image formed on the photosensitive drum may be displayed on the paper. When the paper carrying the toner image continues to be conveyed to a fixing device, toner particles may be melted into the paper under the action of heat and pressure, and the paper may be finally discharged from the position of the paper discharging roller to complete printing process.

The fixing device may mainly include a fixing roller, a heater and a pressing roller. The heater may be configured to heat the fixing roller, the fixing roller may be configured to fix the toner image, and the pressing roller may be configured to be pressed to be in contact with the fixing roller. When the paper carrying the toner image passes through a fixing clamping part where the fixing roller and the pressing roller are pressed against each other, the toner particles may be melted into paper fibers under the action of heat and pressure, so that the toner image may be fixed on the paper.

In order to obtain or store relevant information of the fixing device, by disposing a chip on the fixing device, the image forming apparatus may read information of the fixing device stored in the chip or store information related to the fixing device in the chip, such that the fixing device may be ensured to operate normally, and the print image quality may be further ensured.

In the existing technology, the chip may be normally disposed on the fixing device main body. However, since pressure and heating are required during the operation of the fixing device, a large torque may be needed for the rotation of rotatable fixing roller. In the process of long-time durable printing, as the bearing of the fixing roller and the pressing roller are worn, the rotation torque of the fixing roller in the fixing device may increase continuously. As the torque continues to increase, the force generated by the driving gear on the main body of the image forming apparatus for driving the fixing roller gear onto the fixing roller gear in the direction of the center distance between the fixing roller gear and the driving gear on the image forming apparatus may also increase. Under the action of such force, the position of the fixing device main body relative to the main body of the image forming device may have a slight jump, which may cause unstable contact between the chip configured on the fixing device main body and the electrical contact configured on the image forming apparatus, thereby affecting print image quality.

SUMMARY

The present disclosure provides a fixing device, configured in an image forming apparatus. The fixing device includes: a device main body, including a heater, where the device main body includes a driving end connected to a power outputting part of the image forming apparatus and a non-driving end opposite to the driving end; a locking element, disposed on the non-driving end of the device main body; and a chip, including a contact part. When the device main body is installed on the image forming apparatus, the locking element is connected to the image forming apparatus, and the contact part of the chip is electrically connected to the image forming apparatus; and a projection of the contact part of the chip in an axial direction of the heater intersects a projection of the locking element in the axial direction of the heater.

The present disclosure also provides an image forming apparatus, including an apparatus main body and a fixing device. The fixing device includes: a device main body, including a heater, where the device main body includes a driving end connected to a power outputting part of the image forming apparatus and a non-driving end opposite to the driving end; a locking element, disposed on the non-driving end of the device main body; and a chip, including a contact part. When the device main body is installed on the image forming apparatus, the locking element is connected to the image forming apparatus, and the contact part of the chip is electrically connected to the image forming apparatus; and a projection of the contact part of the chip in an axial direction of the heater intersects a projection of the locking element in the axial direction of the heater. The apparatus main body includes a fixing part including an electrical contact corresponding to the contact part of the chip. The device main body is connected to the fixing part of the apparatus main body through the locking element.

Compared with the existing technology, the fixing device of the present disclosure may include the device main body, the locking element and the chip; the chip may include the contact part; and the locking element may be disposed on the non-driving end of the device main body. When the device main body is installed on the image forming apparatus, the locking element may be connected to the image forming apparatus, the contact part of the chip may be electrically connected to the image forming apparatus, and the projection of the contact part of the chip on the axial direction of the heater may intersect the projection of the locking element on the axial direction of the heater. Furthermore, the connection between the contact point of the chip and the electrical contact of the image forming apparatus may be more stable by the maintaining force between the locking element and the image forming apparatus, which may avoid poor electrical contact caused by the position of the fixing device relative to the main body of the image forming apparatus.

Figure 1:
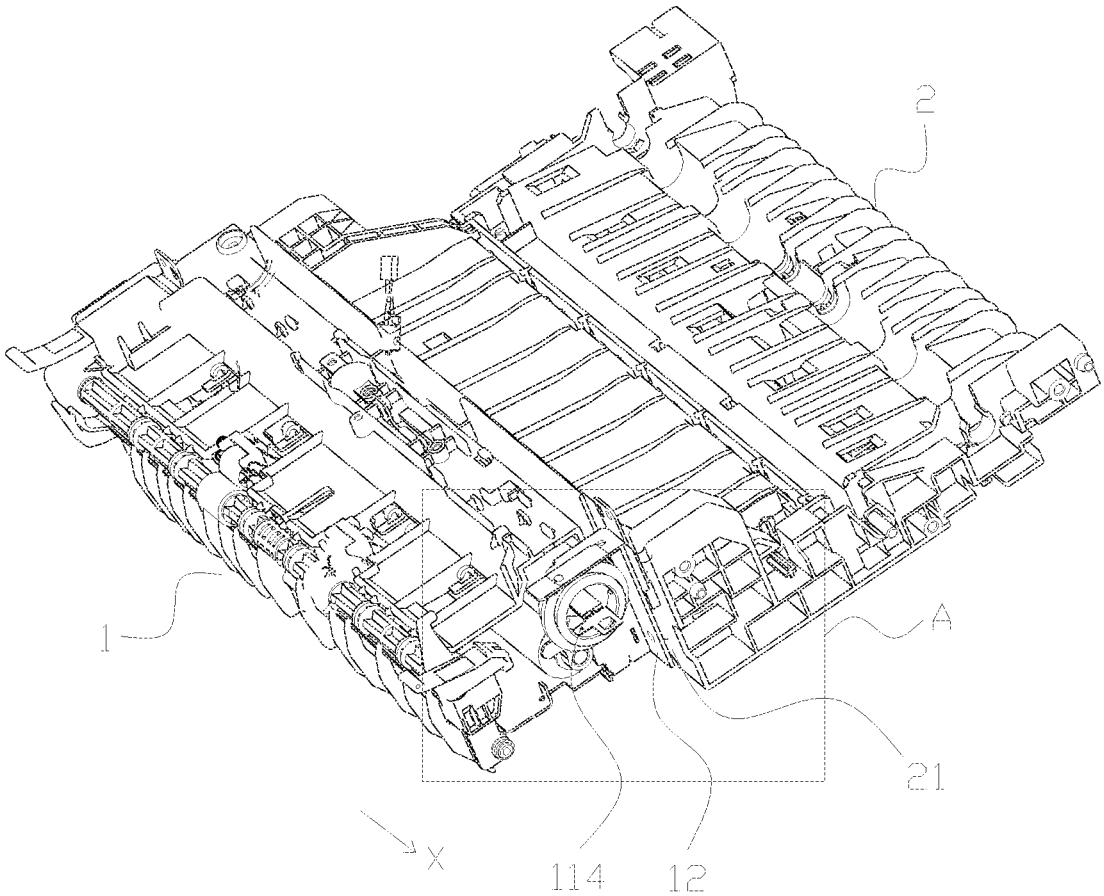
FIG. 1 illustrates a perspective installation view of a fixing device and a conveying frame provided by exemplary embodiments of the present disclosure.
Figure 2:
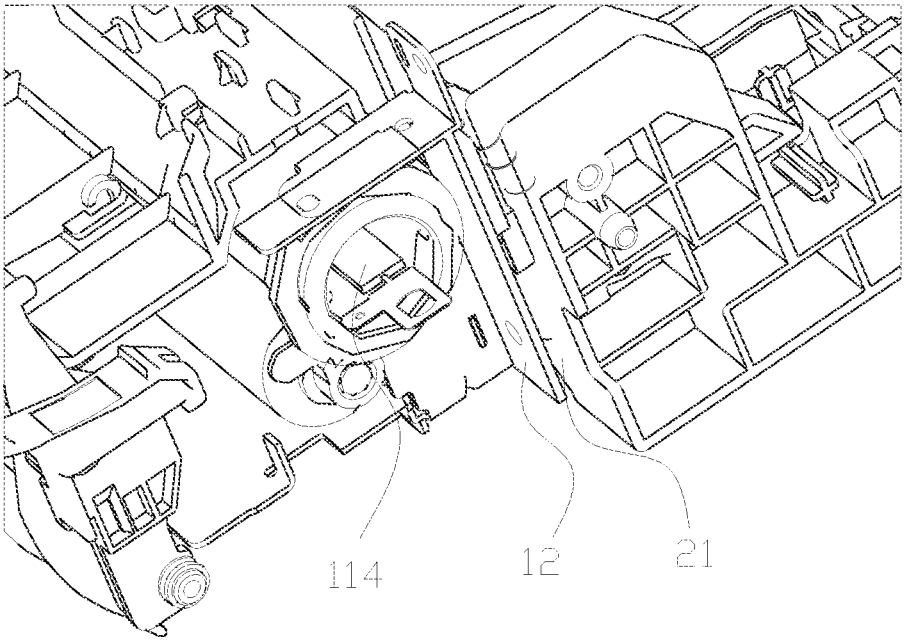
FIG. 2 illustrates a local enlarged view of a location A in FIG. 1.
Figure 3:
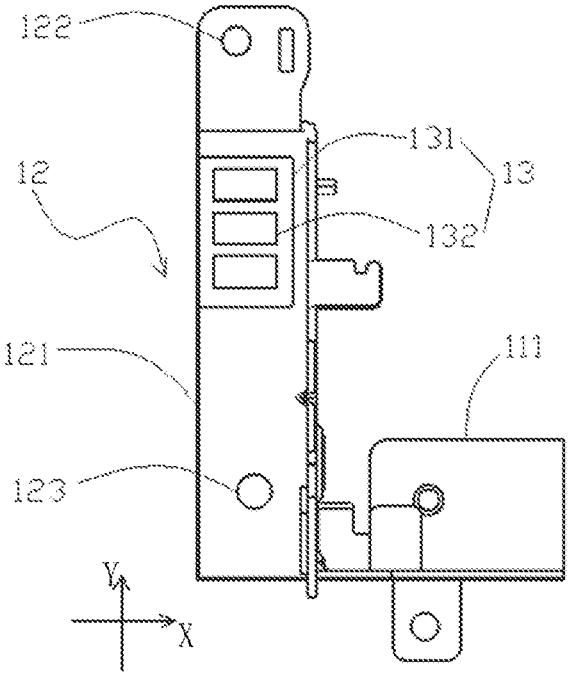
FIG. 3 illustrates a structural schematic of a locking element provided by exemplary embodiments of the present disclosure.
Figure 4:
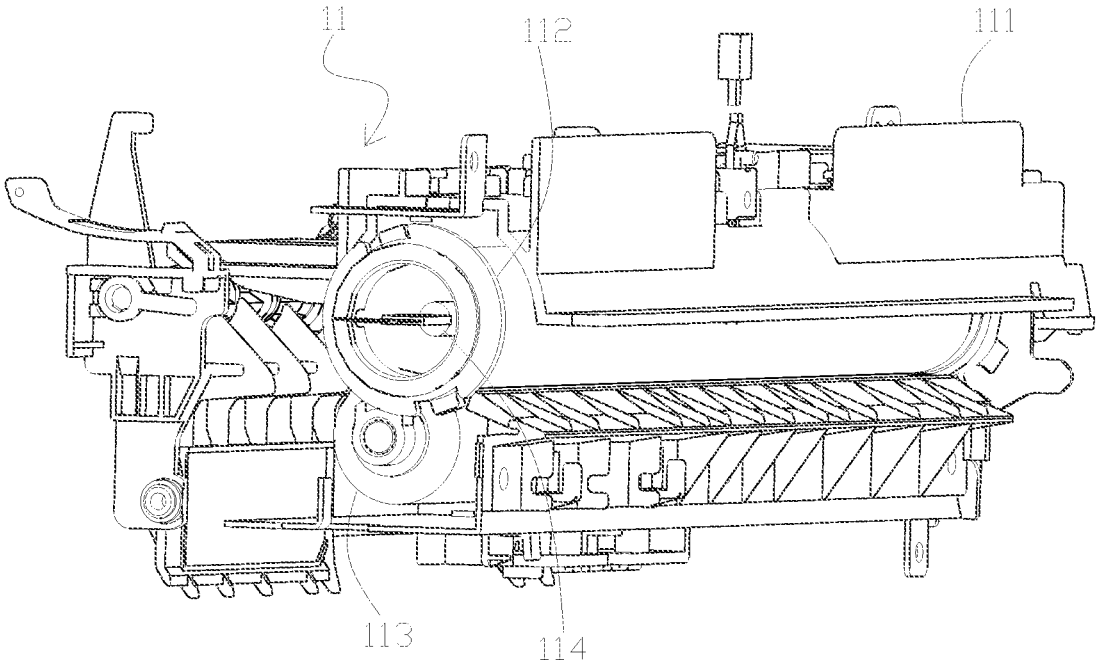
FIG. 4 illustrates a perspective view of a fixing device provided by exemplary embodiments of the present disclosure.

Drawing labels: 1—fixing device; 11—device main body; 111—frame; 112—fixing roller; 113—pressing roller; 114—heater; 12—locking element; 121—locking element main body; 122—first locking part; 123—second locking part; 13—chip; 131—chip main body; 132—contact part; 2—conveying frame; 21—fixing part; 3—installation frame

DETAILED DESCRIPTION

In order to clearly describe the objectives, technical solutions and advantages of the present disclosure, the present disclosure is further described in detail with reference to the accompanying drawings and embodiments hereinafter. It should be understood that specific embodiments described herein are only used to explain the present disclosure, but not to limit the present disclosure.

In the description of the present disclosure, unless otherwise expressly specified and limited, the terms "first" and "second" are only used for the purpose of description and should not be construed as indicating or implying relative importance. Unless otherwise specified or explained, the term "plurality" refers to two or more; the terms "connection", "fixation" and the like should be understood in a broad sense. For example, "connection" may be a fixed connection, a detachable connection, an integral connection, or an electrical connection; and may be a direct connection or an indirect connection through an intermediate medium. For those skilled in the art, specific meanings of above-mentioned terms in the present disclosure may be understood according to specific situations.

In the description of the present disclosure, it should be understood that directional words such as "upper" and "lower" described in embodiments of the present disclosure are described from the angles shown in the drawings and should not be construed as a limitation on embodiments of the present disclosure. Also, in the context of the present disclosure, it should also be understood that when an element is referred to as being "on" or "under" another element, it may not only be directly connected "on" or "under" the other element, but also indirectly connected "on" or "under" another element through intermediate elements.

The present disclosure provides a fixing device and an image forming apparatus. An exemplary fixing device includes a device main body, including a heater, where the device main body includes a driving end connected to a power outputting part of the image forming apparatus and a non-driving end opposite to the driving end; a locking element, disposed on the non-driving end of the device main body; and a chip, including a contact part. When the device main body is installed on the image forming apparatus, the locking element is connected to the image forming apparatus, and the contact part of the chip is electrically connected to the image forming apparatus; and a projection of the contact part of the chip in an axial direction of the heater intersects a projection of the locking element in the axial direction of the heater.

In an installation state of the fixing device of the present disclosure, the connection between the contact part of the chip and an electrical contact of the image forming apparatus is more stable by a holding force between the locking element and the image forming apparatus, which prevents poor electrical contact caused by a position jump of the fixing device relative to the main body of the image forming apparatus.

Referring to FIGS. 1-4, embodiments of the present disclosure provide a fixing device 1, which is configured in an image forming apparatus. The image forming apparatus may include a conveying frame 2; and the conveying frame 2 may include a fixing part 21, where the fixing part 21 may have an electrical contact. The fixing device 1 may include a device main body 11, a locking element 12, and a chip 13. The device main body 11 may have a driving end and a non-driving end. The driving end of the device main body 11 may be configured to be connected to a power outputting part of the image forming apparatus; and the non-driving end of the device main body 11 may be disposed opposite to the driving end of the device main body 11. The device main body 11 may include a heater 114. The chip 13 may include a chip main body 131 and a contact part 132. The chip main body 131 may include a storage element for storing information related to the fixing device; the contact part 132 may be configured to be in contact with the electrical contact of the image forming apparatus to achieve electrical connection; and the storage element may be electrically connected to the contact part 132. During an installation process, the locking element 12 may be disposed on the non-driving end of the device main body 11. When the device main body 11 is installed on the image forming apparatus, the locking element 12 may be connected to the image forming apparatus through the locking element, and the contact part 132 of the chip 13 may be in contact with the electrical contact of the image forming apparatus to achieve electrical connection. In addition, the projection of the contact part 132 of the chip 13 in the axial direction of the heater 114 (the axial direction of the heater is the X direction in FIGS. 1-4) may intersect the projection of the locking element 12 in the axial direction of the heater 114, where the X direction is defined as the axial direction of a fixing roller 112 in FIGS. 1-4.

In one embodiment, in the installation state of the fixing device, the projection of the contact part 132 of the chip 13 on the X axis may intersect the projection of the locking element 12 on the X axis. Furthermore, the connection between the contact part 132 of the chip 13 and the electrical contact of the image forming apparatus may be more stable by the holding force between the locking element 12 and the image forming apparatus, which may prevent poor electrical contact caused by the position jump of the fixing device relative to the main body of the image forming apparatus.

In one embodiment, the chip main body 131 may be disposed on the locking element 12; and the contact part 132 may be disposed on the chip main body 131. It can be understood that in other embodiments, the chip main body 131 may also be disposed on the device main body 11; the contact part 132 may also be disposed on the locking element 12 or the cantilever of the device main body 11 and may be electrically connected to the chip main body 131 through wires or other manners; or the contact part 132 may also be disposed on other parts. When the fixing device is installed on the image forming apparatus through the locking element 12, through rotation or other manners, the projection of the contact part 132 of the chip 13 in the X axis may intersect the projection of the locking element disposed on the non-driving end of the device main body in the X-axis, such that the contact part 132 of the chip 13 may be stably connected to the electrical contact of the fixing part 21.

In one embodiment, the locking element 12 may be disposed on the non-driving end of the device main body 11, the chip main body 13 may be disposed on the locking element 12, and the contact part 132 may be disposed on the chip main body 131. When the device main body 11 is installed on the image forming apparatus, the locking element 12 may be connected to the fixing part 21 through the locking element, and the contact part 132 of the chip 13 may be electrically connected to the electrical contact on the fixing part 21, so that the stability of the electrical connection between the contact part 132 of the chip 13 and the electrical contact of the fixing part 21 may be ensured by the connection between the locking element 12 and the fixing part 21.

Specifically, the locking element 12 may include a locking element main body 121, a first locking part 122, and a second locking part 123. The first locking part 122 and the second locking part 123 may be respectively disposed on two ends of the locking element main body 121. The chip main body 131 may be disposed on the outer surface of the locking element main body 121 and between the first locking part 122 and the second locking part 123; the contact part 132 may be disposed on the outer surface of the chip main body 131; and the connecting line between the first locking part 122 and the second locking part 123 may partially overlap the contact part 132. In one embodiment, the chip 13 may be disposed on the locking element main body 121 and between the first locking part 122 and the second locking part 123; when the locking element 12 is connected to the fixing part 21 through the first locking part 122 and the second locking part 123, the contact part 132 on the chip 13 between the first locking part 122 and the second locking part 123 may be in a more stably contact with the electrical contact on the fixing part 21 to realize electrical connection.

In one embodiment, locking holes may be formed on both the first locking part 122 and the second locking part 123; and threaded holes corresponding to the locking holes on the first locking part 122 and the second locking part 123 may be respectively formed on the fixing part 21. When the locking element 12 is connected to the fixing part 21, the screws may pass through the locking holes on the first locking part 122 and the second locking part 123 and be inserted into the threaded holes on the fixing part 21, so that the locking element 12 may be fixedly connected to the fixing part 21. It can be understood that, in other embodiments, the first locking part 122 and the second locking part 123 may also include locking protrusions; and locking grooves corresponding to the locking protrusions on the first locking part 122 and the second locking part 123 may be respectively formed on the fixing part 21. When the locking element 12 is connected to the fixing part 21, the locking protrusions on the first locking part 122 and the second locking part 123 may be inserted into the locking grooves on the fixing part 21 to be engaged, such that the locking element 12 may be fixedly connected to the fixing part 21; or locking holes may also be formed on the first locking part 122, and the second locking part 123 may include locking protrusions; or the first locking part 122 may include locking protrusions, and locking holes may be formed on the second locking part 123.

Furthermore, the device main body 11 may include a frame 111, a fixing roller 112, a pressing roller 113, and a heater 114. During an installation process, the fixing roller 112 and the pressing roller 113 may be respectively installed on the frame 111, such that the fixing roller 112 and the pressing roller 113 may together form a fixing clamping part, the heater 114 may be disposed in the fixing roller 112 for heating the fixing roller 112; and the locking element 12 may be fixed on one end of the frame 111. The fixing roller 112 may also be replaced by a fixing belt, and the heater 114 may be a halogen lamp, a ceramic plate or an electromagnetic induction heating. The locking element 12 and the frame 111 may be formed into one single piece. When assembled fixing device 1 is installed on the image forming apparatus, the locking element 12 may be connected to the fixing part 21 of the image forming apparatus, and the driving end of the fixing device 1 may be connected to the power outputting part of the image forming apparatus.

In one embodiment, since the chip 13 is installed on the locking element 12 to be far away from a heat source. Thus, problems such as erasure of data stored in the chip 13, thermal deformation of the chip, and read/write access errors caused by thermal radiation may be avoided.

Figure 5:
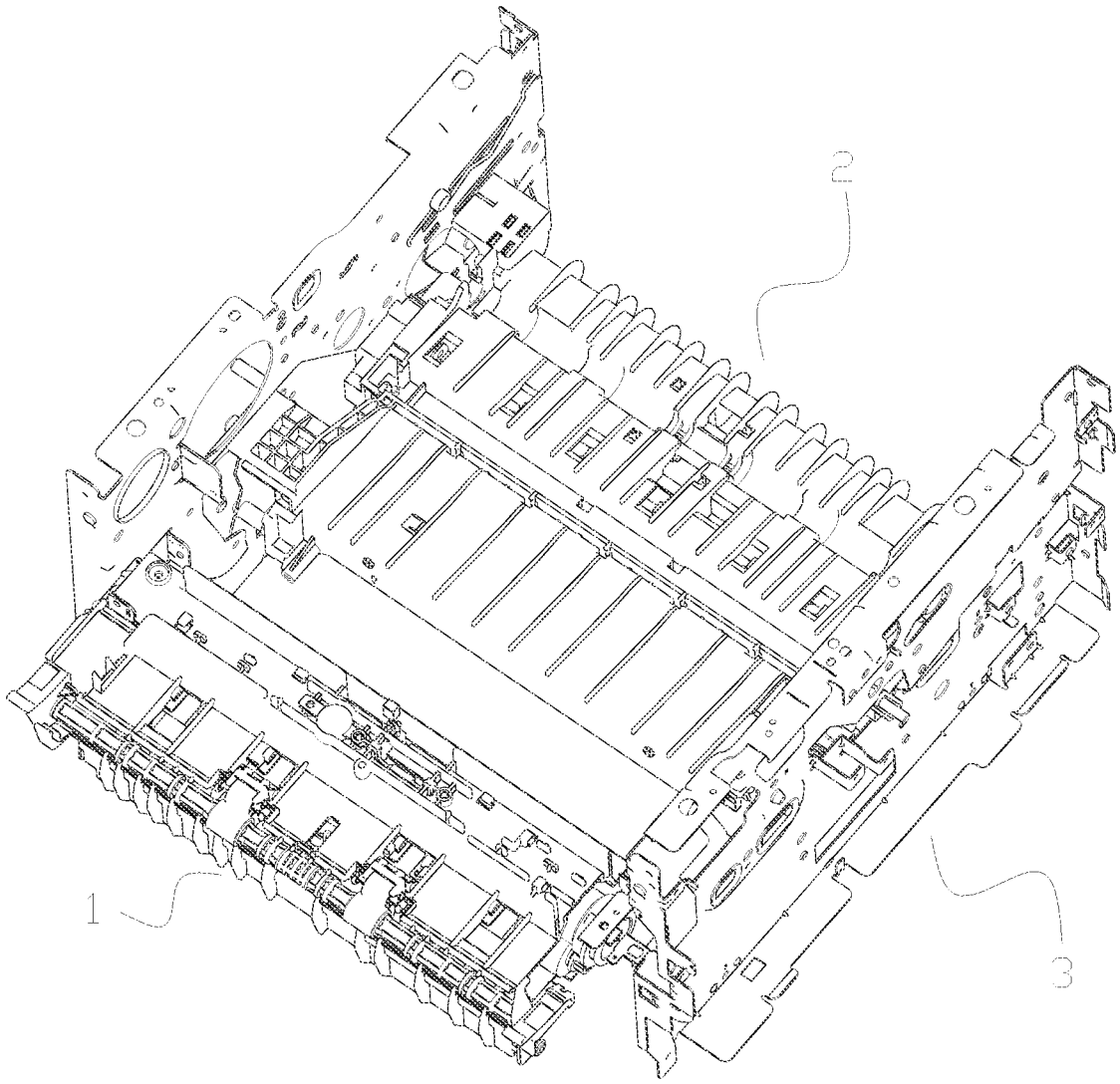
FIG. 5 illustrates a perspective installation view of a fixing device, a conveying frame, and an installing frame provided by exemplary embodiments of the present disclosure.

Correspondingly, embodiments of the present disclosure also provide an image forming apparatus. Referring to FIG. 5, the image forming apparatus may include above-mentioned fixing device 1, the conveying frame 2 and an installation frame 3; and the conveying frame 2 may have the fixing part 21. During an installation process, the fixing device 1 and the conveying frame 2 may be respectively installed on the installation frame 3, the locking element 12 of the fixing device 1 may be connected to the fixing part 21 of the conveying frame 2, and the contact part of the chip 13 may be in contact with the electrical contact of the fixing part 21 to achieve electrical connection.

In addition, the fixing part 21 may be disposed on the installation frame 3. During an installation process, the fixing device 1 and the conveying frame 2 may be respectively installed on the installation frame 3, the locking element 12 of the fixing device 1 may be connected to the fixing part 21 of the installation frame 3, and the contact part of the chip 13 may be in a contact with the electrical contact of the fixing part 21 to achieve electrical connection.

Specifically, a locking hole may be formed on the locking element 12, a threaded hole may be formed on the fixing part 21, and the locking element 12 may be threadedly connected to the fixing part 21 through the locking hole, the threaded hole, and a screw. It can be understood that, in other embodiments, the locking element 12 may also be disposed with the locking protrusion, the locking groove corresponding to the locking protrusion of the locking element 12 may be formed on the fixing part 21, and the locking element 12 may be engaged with the fixing part 21 through the locking protrusion and the locking groove.

The above description may merely be optional embodiments of the present disclosure, which may not limit the protection scope of the present disclosure. Changes or substitutions which can be easily thought by those skilled in the art within the technical scope disclosed by the present disclosure should be covered by the protection scope of the present disclosure. The protection scope of the present disclosure shall be subject to the protection scope of the claims.

What is claimed is:

1. A fixing device, configured in an image forming apparatus, the fixing device comprising:

a device main body, including a heater, wherein the device main body includes a driving end connected to a power outputting part of the image forming apparatus and a non-driving end opposite to the driving end;

a locking element, disposed on the non-driving end of the device main body; and a chip, including a contact part, wherein:

when the device main body is installed on the image forming apparatus, the locking element is connected to the image forming apparatus, and the contact part of the chip is electrically connected to the image forming apparatus; wherein the chip is positioned at a side of the locking element further away from the heater.

2. The fixing device according to claim 1, wherein:

the locking element includes a locking element main body, a first locking part, and a second locking part;

the first locking part and the second locking part are respectively disposed on two ends of the locking element main body; and the contact part of the chip is disposed on the locking element main body and between the first locking part and the second locking part.

3. The fixing device according to claim 2, wherein:

the chip further includes a chip main body; the chip main body is disposed on the locking element main body; and the contact part is disposed on the chip main body.

4. The fixing device according to claim 2, wherein:

the first locking part includes a locking hole, and/or the second locking part includes a locking hole.

5. The fixing device according to claim 2, wherein:

the first locking part includes a locking protrusion, and/or the second locking part includes a locking protrusion.

6. The fixing device according to claim 2, wherein:

the device main body includes a frame, a fixing roller, a pressing roller, and the heater; the fixing roller and the pressing roller are respectively installed on the frame; the heater is disposed in the fixing roller; and the locking element is disposed on the frame.

7. An image forming apparatus, comprising:

a fixing device comprising:

a device main body, including a heater, wherein the device main body includes a driving end connected to a power outputting part of the image forming apparatus and a non-driving end opposite to the driving end;

a locking element, disposed on the non-driving end of the device main body; and a chip, including a contact part, wherein:

when the device main body is installed on the image forming apparatus, the locking element is connected to the image forming apparatus, and the contact part of the chip is electrically connected to the image forming apparatus; wherein the chip is positioned at a side of the locking element further away from the heater; and an apparatus main body comprising:

a fixing part including an electrical contact corresponding to the contact part of the chip, wherein the device main body is connected to the fixing part of the apparatus main body through the locking element.

8. The image forming apparatus according to claim 7, wherein:

the locking element is connected to the fixing part through a screw connection manner.

9. The image forming apparatus according to claim 7, wherein:

the locking element is connected to the fixing part through a snap connection manner.

10. The image forming apparatus according to claim 7, wherein:

the locking element includes a locking element main body, a first locking part, and a second locking part; the first locking part and the second locking part are respectively disposed on two ends of the locking element main body; and the contact part of the chip is disposed on the locking element main body and between the first locking part and the second locking part.

11. The image forming apparatus according to claim 10, wherein:

the chip further includes a chip main body; the chip main body is disposed on the locking element main body; and the contact part is disposed on the chip main body.

12. The image forming apparatus according to claim 10, wherein:

the first locking part includes a locking hole, and/or the second locking part includes a locking hole.

13. The image forming apparatus according to claim 10, wherein:

the first locking part includes a locking protrusion, and/or the second locking part includes a locking protrusion.

14. The image forming apparatus according to claim 10, wherein:

the device main body includes a frame, a fixing roller, a pressing roller, and the heater; the fixing roller and the pressing roller are respectively installed on the frame; the heater is disposed in the fixing roller; and the locking element is disposed on the frame.

15. The fixing device according to claim 1, wherein a conveying frame of the image forming apparatus and the device main body are positioned side-by-side.

16. The fixing device according to claim 1, wherein the axial direction is named axial direction X, and the direction at an angle to the axial direction X is named direction Z, wherein an outer contour of the contact part of the chip is enclosed within an outer contour of the locking element, viewed from the direction Z.

17. The fixing device according to claim 1, wherein the axial direction is named axial direction X, and the direction at an angle to the axial direction X is named direction Z, and wherein the contact part is a first contact part, the chip includes a second contact part positioned space apart from the first contact along a thickness direction Y at an angle to the axial direction X and at an angle to the direction Z.

* * * * *